US006831626B2

(12) United States Patent
Nakamura et al.

(10) Patent No.: US 6,831,626 B2
(45) Date of Patent: Dec. 14, 2004

(54) TEMPERATURE DETECTING CIRCUIT AND LIQUID CRYSTAL DRIVING DEVICE USING SAME

(75) Inventors: Toshihiro Nakamura, Nara (JP); Masahiko Monomohshi, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 360 days.

(21) Appl. No.: 09/835,417

(22) Filed: Apr. 17, 2001

(65) Prior Publication Data

US 2001/0048421 A1 Dec. 6, 2001

(30) Foreign Application Priority Data

May 25, 2000 (JP) ..... 2000-155289

(51) Int. Cl.[7] ..... G09G 3/36

(52) U.S. Cl. ..... 345/101; 345/212

(58) Field of Search ..... 345/101, 87, 91, 345/92, 106, 698, 699, 212, 213, 214, 204, 205, 206, 99

(56) References Cited

U.S. PATENT DOCUMENTS

| | | | | |
|---|---|---|---|---|
| 4,355,344 A | * | 10/1982 | Felici et al. | 361/103 |
| 4,468,634 A | * | 8/1984 | Takagi et al. | 331/60 |
| 4,721,363 A | * | 1/1988 | Inoue | 428/38 |
| 5,025,248 A | * | 6/1991 | Bergeron | 340/596 |
| 5,383,083 A | * | 1/1995 | Shinoda et al. | 361/103 |
| 5,453,678 A | * | 9/1995 | Bertolini et al. | 323/282 |
| 5,555,152 A | * | 9/1996 | Brauchle et al. | 361/103 |
| 5,723,915 A | * | 3/1998 | Maher et al. | 307/131 |
| 5,748,171 A | * | 5/1998 | Ishizaki et al. | 345/101 |
| 6,137,668 A | * | 10/2000 | Feldtkeller | 361/103 |
| 6,376,994 B1 | * | 4/2002 | Ochi et al. | 315/169.1 |

FOREIGN PATENT DOCUMENTS

| | | |
|---|---|---|
| JP | 01-266514 | 10/1989 |
| JP | 3-48737 | 3/1991 |
| JP | 06-258140 | 9/1994 |
| JP | 08-272465 | 10/1996 |
| JP | 09-229778 | 9/1997 |
| JP | 2000-098345 | 4/2000 |

OTHER PUBLICATIONS

Japanese Office Action dated Dec. 2, 2003 (along with English Translation thereof).

* cited by examiner

*Primary Examiner*—Amr Awad
*Assistant Examiner*—Alecia D. Nelson
(74) *Attorney, Agent, or Firm*—Nixon & Vanderhye P.C.

(57) ABSTRACT

In a temperature detecting circuit of the present invention, a bias voltage Vin with relatively steep temperature characteristics is supplied to an inverting input terminal of an inverting amplifier via a resistance R1, a resistance R2 is disposed between the inverting input terminal and an output terminal of the inverting amplifier, and an output of the inverting amplifier is supplied to a non-inverting input terminal of a non-inverting amplifier, and an inverting input terminal of the non-inverting amplifier is connected with a source of a reference potential via a resistance R3 and further connected with an output terminal via a resistance R4. Desired temperature characteristics can be obtained by properly setting resistivities of the resistances R1 and R2, while a desired output voltage value can be obtained for the temperature characteristics given by the inverting amplifier by properly setting resistivities of the resistances R3 and R4. This allows temperature detection with relative accuracy between the two bias voltage sources, by the inverting amplifier outputting a voltage according to a difference between two bias voltages Vin and Vbias with different temperature characteristics, enabling the temperature detecting circuit to be adapted to various temperature characteristics and output dynamic range.

11 Claims, 7 Drawing Sheets

TEMPERATURE DETECTING CIRCUIT AND LIQUID CRYSTAL DRIVING DEVICE USING SAME

FIELD OF THE INVENTION

The present invention relates to a temperature detecting circuit, especially to a temperature detecting circuit that performs temperature detection by utilizing temperature-voltage characteristics of circuit elements in semiconductor integrated circuits, and to a liquid crystal driving device that compensates temperature characteristics of a liquid crystal element with a driving voltage in accordance with the detection result.

BACKGROUND OF THE INVENTION

Disclosed in Japanese Unexamined Patent Publication Tokukaihei No. 3-48737 (published on Mar. 1, 1991) is typical conventional technology as the above-mentioned circuit for the temperature detection by utilizing the temperature-voltage characteristics of circuit elements in semiconductor integrated circuits. FIG. 7 is a block diagram showing an electric configuration of a temperature detecting circuit of the conventional technology. This conventional technology is provided with a first bias voltage source b1, a second bias voltage source b2, and an amplifier 3. The first bias voltage source b1 is configured by connecting a series circuit, which includes a constant current source f1 and a plurality of diodes d11 to d1n, between power supplying lines 1 and 2, while the second bias voltage source b2 is configured by connecting a series circuit, which has a constant current source f2 and a plurality of diodes d21 to d2m, between the power supplying lines 1 and 2. The amplifier 3 is for amplifying and outputting a difference between first and second bias voltages from the first and the second bias voltage sources b1 and b2, respectively. A junction between the constant current source f1 and the diode d1n is an output terminal for the first bias voltage, and is connected to one of two input terminals of the amplifier 3, while a junction between the constant current source f2 and the diode d2m is an output terminal for the second bias voltage, and is connected to the other input terminal of the amplifier 3.

Because $n \neq m$, when current values of the constant current sources f1 and f2 are equal to each other, a voltage of $-n \times Vac$ [V] is generated at one of the input terminals of the amplifier 3, while a voltage of $-m \times Vac$ [V] is produced at the other input terminal, where a voltage between anode and cathode of a single diode is Vac [V] and a potential of the power supplying line 1 is the reference. As a result, an offset of $(m-n) \times Vac$ [V] is generated between the two input terminals. Therefore, where the temperature dependence of the voltage between anode and cathode of a single diode is $\Delta Vac$ [V/° C.], a change in temperature by T [° C.] varies the offset between the input terminals of the amplifier 3 by $T \times (m-n) \times \Delta Vac$ [V]. Thus, $A \times T\ (m-n) \times \Delta Vac$ [V] is obtained when A is the gain of the amplifier 3.

In the above-mentioned conventional technology, because the differences between two voltages, namely one from the diodes d11 to d1n of the first bias voltage source b1 and the other from the diodes d21 to d2m of the second bias voltage source b2, are outputted as the detected temperature, the temperature detection can be carried out with relative accuracy between the first and the second bias voltage sources b1 and b2, as long as element characteristics of the respective diodes, namely d11 to d1n and d21 to d2m are equal. Thus, the temperature detection can be performed with high accuracy without requiring individual elements to be highly accurate.

The problems of the technology are that sensitivity of the temperature detection is not arbitrarily adjustable and the output voltage cannot be amplified to a desirable level. Especially, a liquid crystal panel has some characteristics changed significantly depending on ambient temperature, such as relationship of applied voltage-light transmittance characteristics and threshold voltage Vth characteristics of the liquid crystal materials. Therefore, its driving voltage is required to be altered in accordance with the ambient temperature for displaying constantly with a most suitable contrast. Moreover, different types of materials of a liquid crystal element, or even an identical material with different thickness of liquid crystal layers will show some differences in the characteristics such as the threshold voltage Vth.

SUMMARY OF THE INVENTION

The object of the present invention is to provide a temperature detecting circuit that can adapt to various temperature characteristics and output dynamic ranges.

A temperature detecting circuit of the present invention includes an inverting amplifier for outputting a voltage in accordance with a difference between a first bias voltage from a first bias voltage source with relatively steep temperature characteristics and a second bias voltage from a second bias voltage source with relatively gradual temperature characteristics, the inverting amplifier outputting the voltage in accordance with a difference between the first bias voltage and the second bias voltage so as to perform temperature detection with relative accuracy between the first and the second bias voltage sources, the temperature detecting circuit comprising a first resistance for supplying the first bias voltage to an inverting input terminal of the inverting amplifier, a second resistance which is disposed between the inverting input terminal and an output terminal of the inverting amplifier, a non-inverting amplifier having a non-inverting input terminal for receiving the output from the inverting amplifier, a third resistance for supplying a predetermined reference potential to an inverting input terminal of the non-inverting amplifier, and a fourth resistance which is disposed between the inverting input terminal and an output terminal of the non-inverting amplifier.

In the above arrangement, the first bias voltage Vin from the first bias voltage source with the relatively steep temperature characteristics is supplied to the inverting input terminal of the inverting amplifier, while the second bias voltage Vbias from the second bias voltage source with the relatively gradual temperature characteristics is forwarded to the non-inverting input terminal of the inverting amplifier, and by disposing the first resistance R1 between the first bias voltage source and the inverting input terminal and the second resistance R2 between the inverting input terminal and the output terminal, the output voltage Vout1 from the inverting amplifier can be described as follows:

$$Vout1 = -(Vin - Vbias) \times R2/R1 + Vbias.$$

Thus, the difference between the second and the first bias voltages, namely Vbias and Vin, is added to the Vbias, which is the second bias voltage with the relatively gradual temperature gradient, after multiplied by the ratio of the second resistance to the first resistance. Therefore, the temperature detection can be performed with the relative accuracy between the first and the second bias voltage sources. Moreover, desired temperature characteristics can be obtained by appropriately setting the resistivities of the first and the second resistances.

Furthermore, the output voltage Vout1 from the inverting amplifier is amplified by supplying it to the non-inverting input terminal of the non-inverting amplifier, which receives a fed-back output via the fourth resistance and the reference potential via the third resistance at the inverting input terminal.

Therefore, the temperature characteristics obtained by the inverting amplifier can have the desired output voltage value by appropriately setting the resistivities of the third and the fourth resistances.

Moreover, the temperature detecting circuit of the present invention includes the first and the second bias voltage sources, wherein the first and the second bias voltage sources respectively have series circuits connecting a constant current source and one or more stages of a diode or diodes, between power supplying lines, and supply the bias voltages to input terminals of the inverting amplifier from their respective junctions between the constant current sources and the one or more stages of a diode or diodes, so as to create the difference between the temperature characteristics by a difference in element area between the diodes of the respective bias voltage sources.

In the above arrangement, diodes having different current abilities, which are prepared to have different areas per diode between the first and the second bias voltage sources, or to have different numbers of parallel connections of diodes having the same area between the first and the second bias voltage sources, are operated by fixing their operating points by constant currents from constant current sources, thus having different temperature characteristics and easily packaging the diodes in a single semiconductor integrated circuit.

Furthermore, a liquid crystal driving device of the present invention comprises the temperature detecting circuit and utilizing the output voltage from the non-inverting amplifier for driving a liquid crystal element, the liquid crystal driving device having a gain of the inverting amplifier, which is determined by the first and the second resistances and adapts to temperature characteristics of a liquid crystal panel, and having an output voltage level, which is determined by the third and the fourth resistances and the reference potential and adapts to a voltage required for driving the liquid crystal element.

In the above arrangement, the gain of the inverting amplifier is adapted to the temperature characteristics of the liquid crystal panel, such as the relationship of applied voltage-light transmittance characteristics or the threshold voltage Vth, which are varied depending on the types of materials of the liquid crystal element or the thickness of the liquid crystal layers, by setting the resistivities of the first and the second resistances, while the output voltage level is adapted to the voltage necessary to drive the liquid crystal element by setting the third and the fourth resistances and the reference potential.

Therefore, by setting the first to the fourth resistances and the reference potential, an arbitrary driving voltage can be obtained with any temperature characteristics suitable for the liquid crystal panel in use, thus performing display constantly with the optimum contrast.

For a fuller understanding of the nature and advantages of the invention, reference should be made to the ensuing detailed description taken in conjunction with the accompanying drawings.

DESCRIPTION OF THE EMBODIMENTS

Described below is one embodiment of the present invention with reference to FIG. 1 and FIG. 2.

Figure 1:
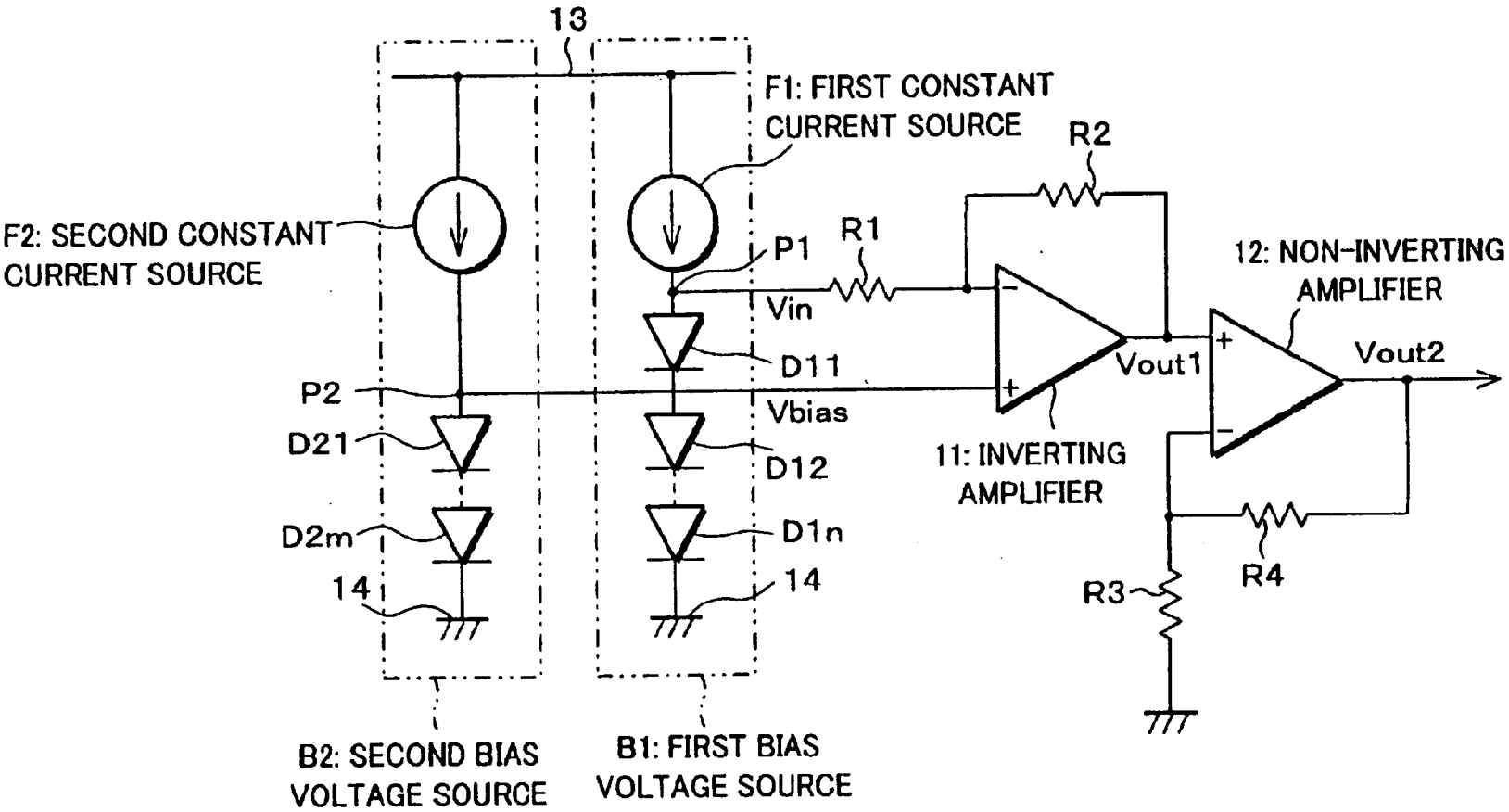
FIG. 1 is a block diagram showing an electric configuration of a temperature detecting circuit in one embodiment of the present invention.

FIG. 1 is a block diagram showing an electric configuration of a temperature detecting circuit in one embodiment of the present invention. The temperature detecting circuit is configured, broadly speaking, with those elements loaded in a semiconductor integrated circuit, namely: first and second bias voltage sources B1 and B2 for generating a temperature gradient, an inverting amplifier 11 and a non-inverting amplifier 12 for amplifying and outputting a difference between first and second bias voltages Vin and Vbias from the bias voltage sources B3 and B2, first and second resistances R1 and R2 for setting a gain of the inverting amplifier 11, and third and fourth resistances R3 and R4 for setting a gain and a reference potential of the non-inverting amplifier 12, respectively.

The bias voltage source B1 is configured by a series circuit connecting a first constant current source F1 and a plurality of diodes D11 to D1n between power supplying lines 13 and 14. A junction P1 between the constant current source F1 and the diode D11 is an output terminal of the first bias voltage Vin (an input terminal (first input terminal) for the inverting amplifier 11). The second bias voltage source B2 is constructed by a series circuit connecting a second constant current source F2 and a plurality of diodes D21 to D2m between the power supplying lines 13 and 14. A junction P2 between the constant current source F2 and the diode D21 is an output terminal of the second bias voltage Vbias (an input terminal (second input terminal) for the inverting amplifier 11). The diodes D11 to D1m may exchange their position with the constant current source F1 while the position of diodes D21 to D2m are also exchangeable with the constant current source F2.

It should be noted that each of the diodes D11 to D1n and each of the diodes D21 to D2m have equal element characteristics and element area, while n is greater than m. Therefore, as shown in FIG. 2, the bias voltage Vin from the bias voltage source B1 with more elements has relatively steep temperature characteristics, while the bias voltage Vbias from the bias voltage source B2 with fewer elements has relatively gradual temperature characteristics.

The bias voltage Vin is supplied to an inverting input terminal of the inverting amplifier 11 via the resistance R1, while the bias voltage Vbias is forwarded directly to a non-inverting input terminal of the inverting amplifier 11. An output voltage Vout1 of the inverting amplifier 11 is given directly to a non-inverting input terminal of the non-inverting amplifier 12, and is supplied to the inverting input terminal of the inverting amplifier 11 via the resistance R2 used for feedback. The section of the inverting amplifier 11, from which the output voltage Vout1 is outputted, is an output terminal thereof. An inverting input terminal of the non-inverting amplifier 12 receives a predetermined reference potential, which is an earthing potential in the example shown in FIG. 1, via the resistance R3, and an output voltage Vout2 of the non-inverting amplifier 12 via resistance R4 used for feedback. The section, in which the earthing potential is inputted, is a third input terminal, while the section, from which the output voltage Vout2 is outputted, is an output terminal of the non-inverting amplifier 12.

Accordingly, when current values of the constant current sources F1 and F2 are equal to each other, and where Vac [V] is a voltage between anode and cathode of a single diode and the potential of the power supplying line 14 is the reference potential, a voltage of n×Vac [V] is produced at the inverting input terminal of the inverting amplifier 11, while a voltage of m×Vac [V] is generated at the non-inverting input terminal. Therefore, an offset of (n−m)×Vac [V] is resulted between the two input terminals. Thus, where temperature dependance of the voltage between anode and cathode of a single diode is ΔVac [V/° C.], the offset between the input terminals of the inverting amplifier 11 is changed by T×(n−m)×ΔVac [V] when temperature is varied by T [° C.], while A×T×(n−m)×ΔVac [V] is obtained where A (=R2/R1) is the gain of the inverting amplifier 11. Moreover, the output voltage Vout 1 is:

$$V\text{out}\mathbf{1}=-(V\text{in}-V\text{bias})\times R\mathbf{2}/R\mathbf{1}+V\text{bias}.$$

It indicates that a difference between the second and the first bias voltages Vbias and Vin is added to the second bias voltage Vbias with the relatively gradual temperature gradient after multiplied by the ratio of the second resistance to the first resistance. Therefore, temperature detection can be performed with relative accuracy between the first and the second bias voltage sources B1 and B2. Moreover, desired temperature characteristics (a temperature gradient) can be obtained by appropriately setting the resistivities of the first and the second resistances R1 and R2.

Moreover, the output voltage Vout1 of the inverting amplifier 11 is, amplified after being supplied to the non-inverting input terminal of the non-inverting amplifier 12 where the inverting input terminal receives the reference potential via the third resistance and the output feeding back via the fourth resistance. Therefore, the output voltage Vout 2 of the non-inverting amplifier 12 is:

$$V\text{out}\mathbf{2}=[(1+R\mathbf{3}/R\mathbf{4})]\times V\text{out}\mathbf{1}$$

$$V\text{out}\mathbf{2}=-[(1+R\mathbf{3}/R\mathbf{4})]\times(V\text{in}-V\text{bias})\times R\mathbf{2}/R\mathbf{1}+[(1+R\mathbf{3}/R\mathbf{4})]\times V\text{bias}].$$

Thus, the temperature characteristics obtained at the inverting amplifier 11 can be converted into the desired output voltage value by appropriately setting the resistivities of the third and the fourth resistances R3 and R4.

Figure 2:
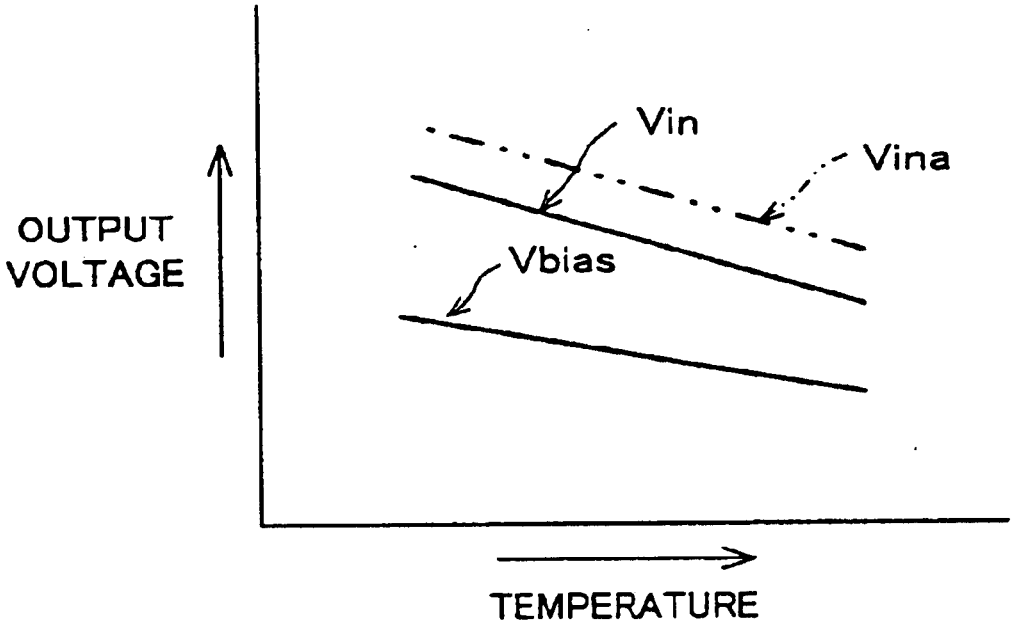
FIG. 2 is a graph illustrating temperature characteristics of bias voltages from two bias voltage sources utilized in the temperature detecting circuit shown in FIG. 1.

Note that, the voltage level can be varied without changing the temperature gradient of the bias voltages Vin and Vbias shown in FIG. 2, when the current values of the constant current sources F1 and F2 are varied from each other without changing the element areas of diodes D11 to D1n and diodes D21 to D2m. For instance, the offset between the input terminals of the inverting amplifier 11 can be increased by increasing the current value of the constant current source F1, as indicated by the line labeled Vina in FIG. 2. The diodes may be replaced with other elements with liner temperature characteristics as shown in FIG. 2. The temperature detecting circuit may be easily packaged into a single chip by using diodes, which can be easily loaded in semiconductor integrated circuits.

Described below is another embodiment of the present invention, with reference to FIG. 3.

Figure 3:
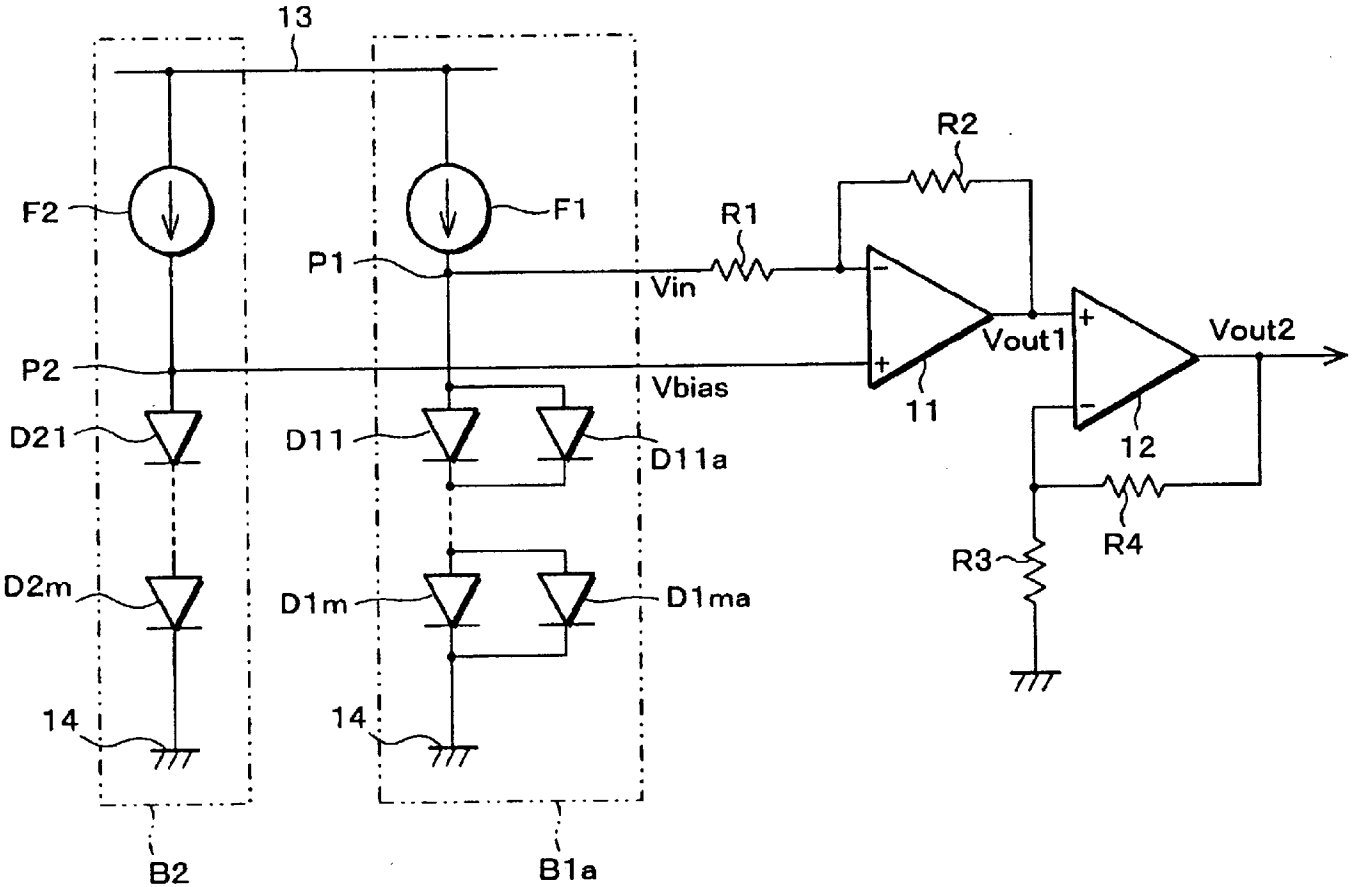
FIG. 3 is a block diagram explaining an electric configuration of a temperature detecting circuit in another embodiment of the present invention.

FIG. 3 is a block diagram of an electric configuration of a temperature detecting circuit in another embodiment of the present invention. Because the temperature detecting circuit has some similarities with the temperature detecting circuit shown in FIG. 1, the explanation is not repeated for the corresponding parts labeled in the same manner. It should be noted that the temperature detecting circuit has a bias voltage source B1a and a bias voltage source B2 equally provided with m number of serial stages of a diode or diodes, while their element areas are different from each other. In the example shown in FIG. 3, the bias voltage source B1a is provided with the diodes D11 to D1m that are respectively connected in parallel with diodes D11a to D1ma. There is no difference among the element areas of the diodes D11 to D1m, the diodes D11a to D1ma, and the diodes D21 to D2m. Therefore, the bias voltage source B1a has an element area two times larger than that of the bias voltage source B2.

The temperature characteristics between the two bias voltage sources B1a and B2 can be differed to each other by operating the thus prepared two diode groups with different current abilities, namely (1) the diodes D11 to D1m, the diodes D11a to D1ma, and (2) the diodes D21 to D2m by fixing their operating points with the use of constant currents from constant current sources F1 and F2. This increases the temperature dependence, ΔVac [V/° C.], of the voltage between the anode and cathode of a single stage of the diode or diodes in the bias voltage source B1a. Thus, the bias voltage source B1a obtains relatively steep temperature characteristics, as in the temperature detecting circuit shown in FIG. 1.

A semiconductor integrated circuit can be provided with the bias voltage sources B1a and B2 with different temperature characteristics easily by thus having different temperature characteristics by the difference in element area.

Note that, besides the foregoing example wherein a difference between the element areas of diode groups in a single stage is created by the number of parallel connections of diodes having the same element area, the difference may be made by providing the first bias voltage source B1 and the second bias voltage source B2 with diodes with different element areas per diode.

Described below is still another embodiment of the present invention, with reference to FIG. 4 through FIG. 6.

Figure 4:
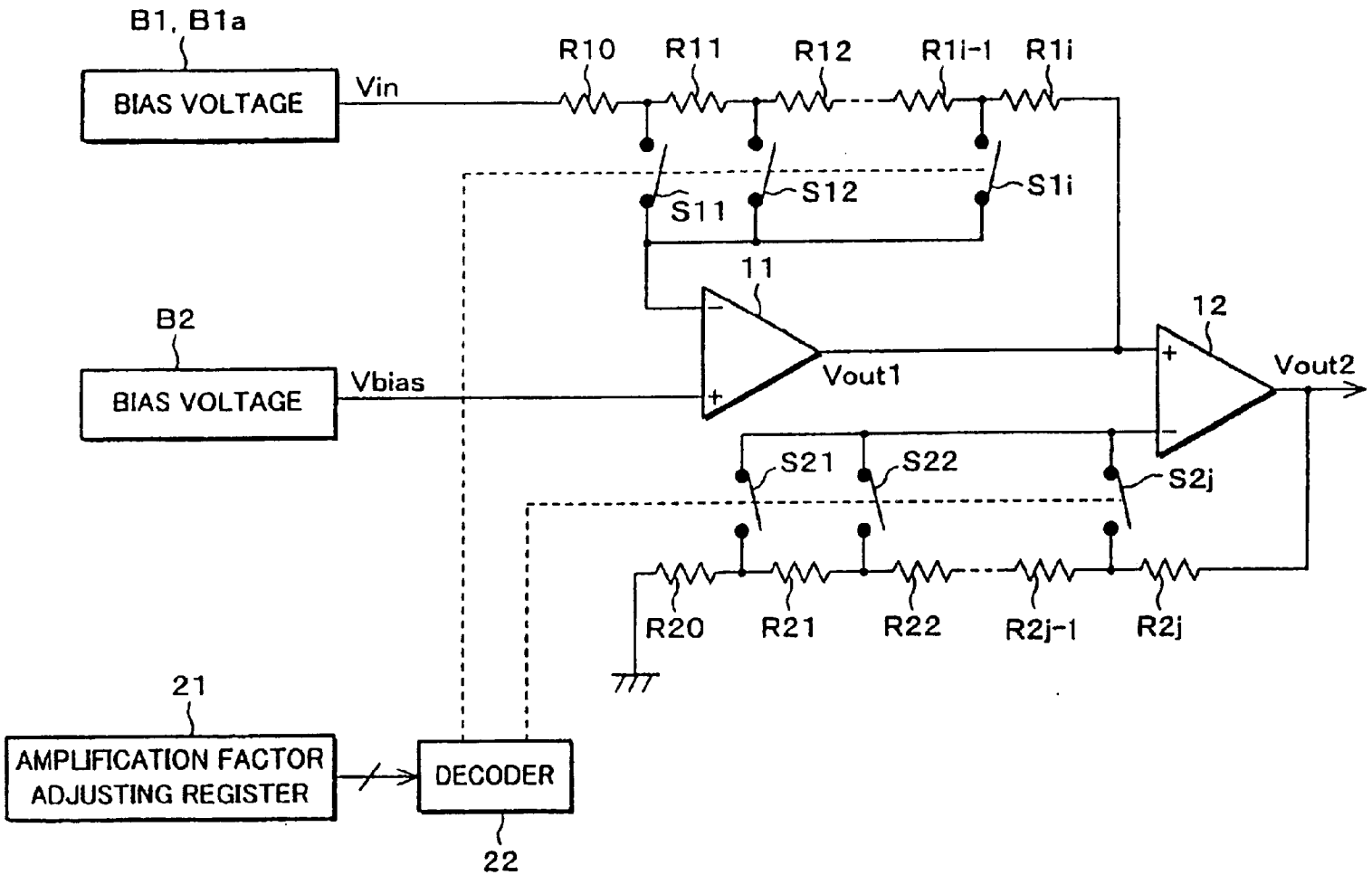
FIG. 4 is a block diagram showing an electric configuration of a temperature detecting circuit in still another embodiment of the present invention.

FIG. 4 is a block diagram that shows an electric configuration of a temperature detecting circuit in the still another embodiment of the present invention. Because the temperature detecting circuit is similar to the temperature detecting circuits shown in FIG. 1 and FIG. 3, the explanation is not repeated for the corresponding parts labeled in the same manner. It should be noted that in this temperature detecting circuit, the R1 and R2, and the R3 and R4 are respectively configured with serially connected resistances of multi-stages: a first resistance group (Resistances R10, R11 to R1i) and a second resistance group (Resistances R20, R21 to R2j), at the junctions in the series resistances R10 to R1i and the series resistances R20 to R2j, and first switches (Switches S10 to S1i) and second switches (Switches S20 to S2j) are provided, respectively.

The temperature detecting circuit is utilized as a power supplying circuit in a liquid crystal driving device. Amplification factor data (switching data), which are set in an amplification factor adjusting register 21 by an external unit not shown here, are decoded in a decoder 22 so that one of the switches S10 to S1i and one of the switches S20 to S2j are turned on, in accordance with the types of a liquid crystal panel in use.

For example, when the switches S12 and S2j are turned on, the resistances, R1, R2, R3 and R4 are, respectively: R1=R10+R11, R2=R12+ . . . +R1i, R3=R20+ . . . R2j-1, and R4=R2j. The switches S10 to S1i and S20 to S2j are analog switches such as MOS transistors or transmission gates, and have control terminals which are on/off controlled by a high level or low level output from the decoder 22.

The switches S10 to S1i and S20 to S2j may be set up, together with the other elements such as the bias voltage sources B1 and B2, in a single semiconductor integrated circuit, while it is also possible to externally provide the switches. Moreover, the amplification factor adjusting register 21 is provided for latching the amplification factor data, which may be either parallel data or serial data of a bit number corresponding to the number of switches in the switches S10 to S1i and S20 to S2j. (Parallel data are shown in FIG. 4.)

Figure 5:
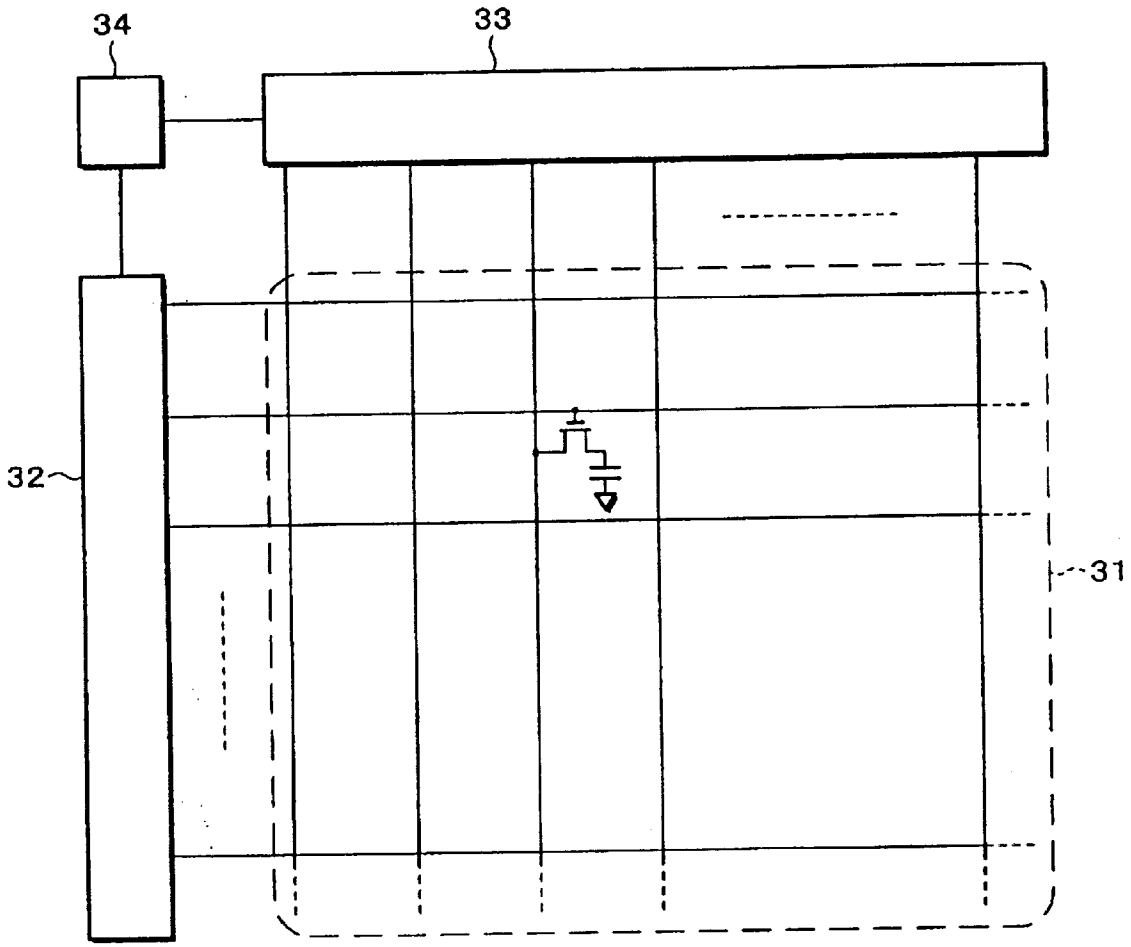
FIG. 5 is a view illustrating a large-screen liquid crystal display device provided with the temperature detecting circuit, like the one mentioned above, as a power supplying circuit for a liquid crystal driving device thereof.
Figure 6:
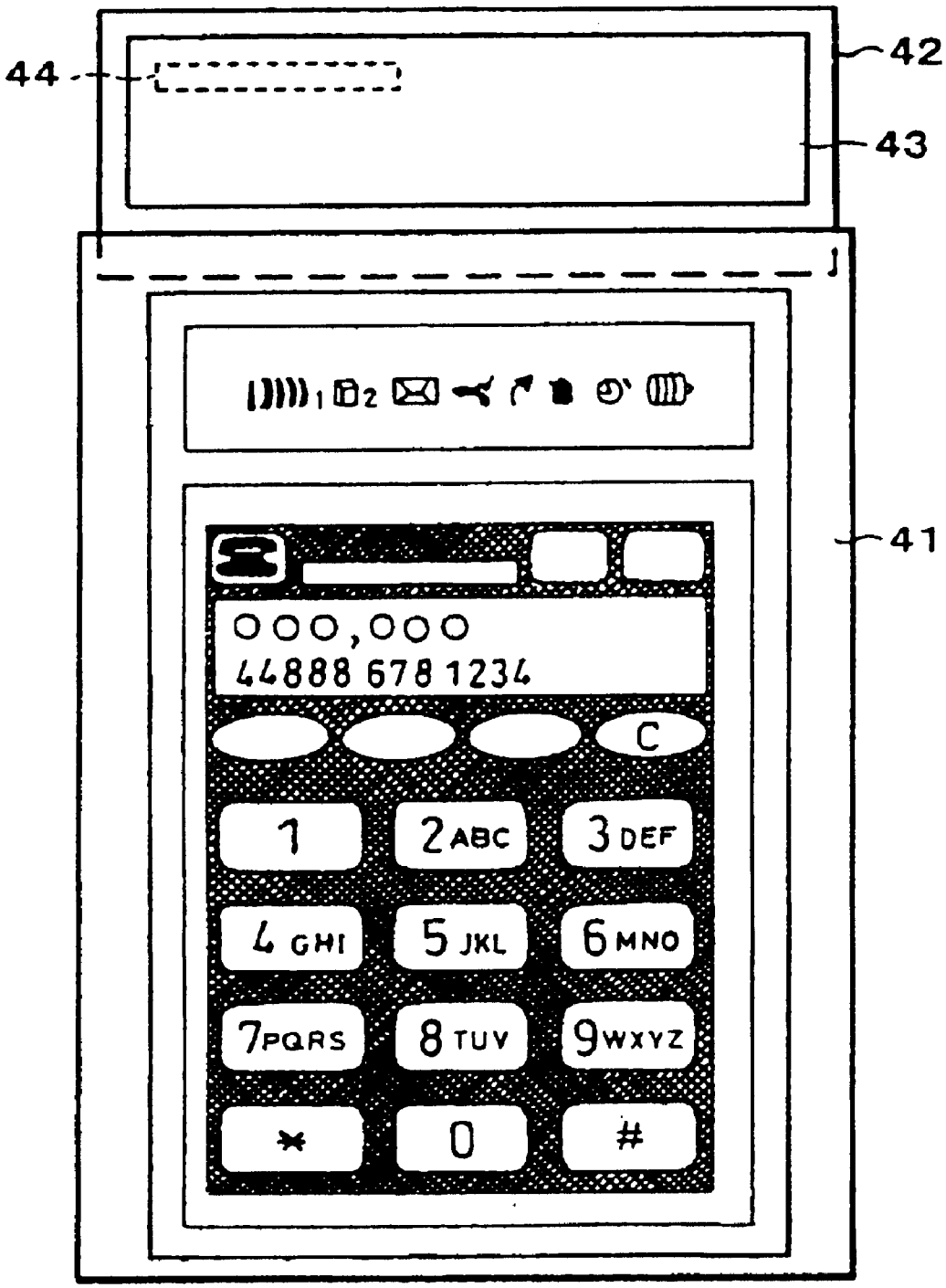
FIG. 6 is a view showing a small-screen liquid crystal display device provided with the temperature detecting circuit, like the one mentioned above, as a power supplying circuit for a liquid crystal driving device thereof.
Figure 7:
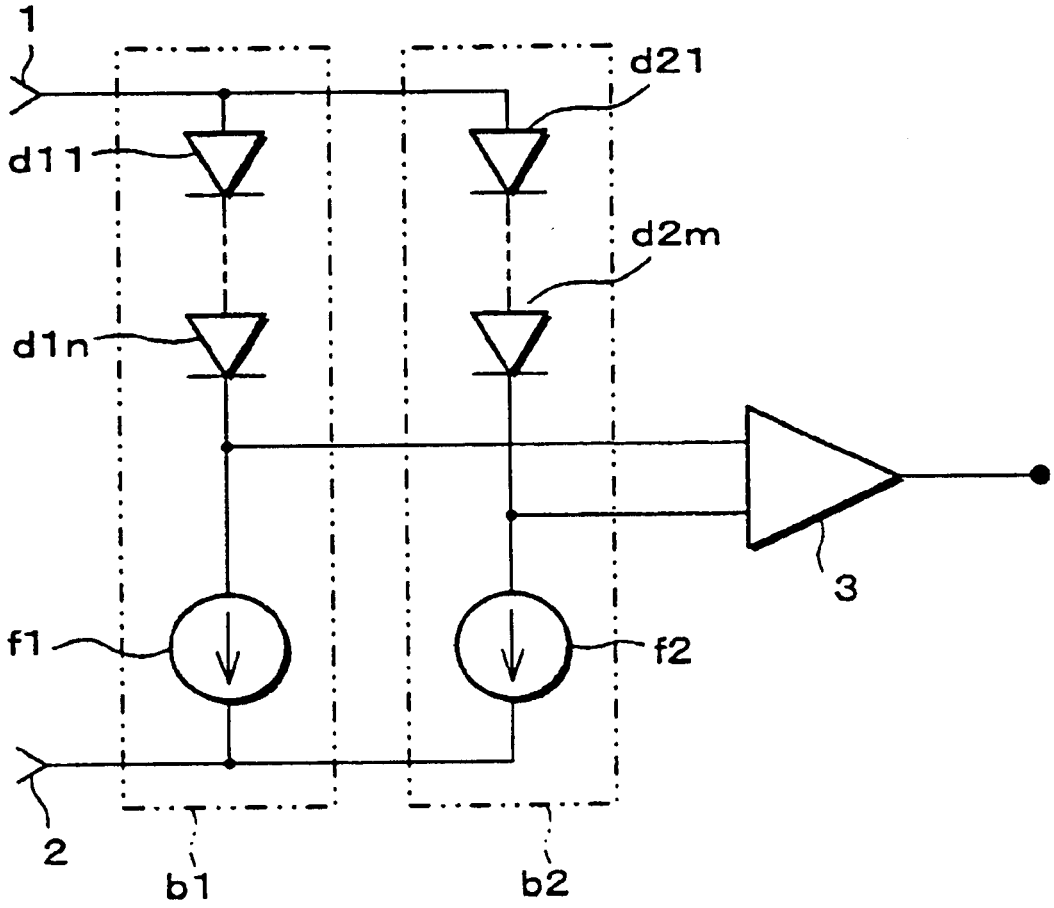
FIG. 7 (PRIOR ART)
FIG. 7 is a block diagram explaining an electric configuration of a typical conventional temperature detecting circuit.

FIG. 5 and FIG. 6 are views explaining liquid crystal display devices provided with a temperature detecting circuit, like the one mentioned above, as a power supplying circuit in its liquid crystal driving device. An example in FIG. 5 is a large-screen liquid crystal display device used, for example, in personal computers, while an example in FIG. 6 is a small-screen liquid crystal display device utilized, for example, in a terminal of portable phones. In FIG. 5, the temperature detecting circuit is used as a power supplying circuit 34 that supplies power to driving circuits 32 and 33 for driving a liquid crystal panel 31. In FIG. 6, the temperature detecting circuit, which is suitable for a single-chip package as described above, is used as a power supplying circuit 44 in a driving circuit 43 mounted on in a Tape Carrier Package (TCP) 42 connected to a liquid crystal panel 41.

For example in the liquid crystal display device in FIG. 5, the output voltage Vout2 of the temperature detecting circuit is used as an output voltage level from the power supplying circuit 34. The output voltage level from the power supplying circuit 34 is divided according to tone characteristics of a liquid crystal element of the liquid crystal panel 31 in accordance with image data to be displayed on the driving circuit 33, and is sent to the liquid crystal element.

In other words, the output voltage Vout2 of the temperature detecting circuit becomes a standard voltage for driving the liquid crystal, which is utilized for generating a liquid crystal driving voltage to be sent to the liquid crystal panel 31 so as to drive the liquid crystal panel 31. Hence, the voltage level, which is divided on the basis of the standard voltage for driving the liquid crystal, is supplied from the power supplying circuit 34 to the driving circuits 32 and 33. Note that, the temperature detecting circuit can be applied in any panel, for example, a STN liquid crystal panel or a TFD liquid crystal panel, while a TFT liquid crystal panel is shown in FIG. 5.

The resistivities of the resistances R1 to R4 are set, according to temperature characteristics of the liquid crystal panels such as relationship of applied voltage-light transmittance characteristics and a threshold voltage Vth, which are varied depending on types of the materials of the liquid crystal element or the thickness of the liquid crystal layer in the liquid crystal panels 31 and 41, so as to be compatible with liquid crystal panels with various temperature characteristics, thus performing display constantly with the optimum contrast. Specifically, the gain of the inverting amplifier 11 is adapted to the temperature characteristics of the liquid crystal panel, such as the relationship of the applied voltage-light transmittance characteristics and the threshold voltage Vth, by setting the resistivities of the resistance R1 and the resistance R2, while the output voltage level is adapted to a voltage required for driving the liquid crystal element by setting the resistivities of the resistance R3 and the resistance R4 and the reference potential.

As discussed, the temperature detecting circuit of the present invention, which is a temperature detecting circuit for outputting a voltage corresponding to a difference between bias voltages from two bias voltage sources with different temperature characteristics, is provided with an inverting amplifier for obtaining a difference between the bias voltages, said inverting amplifier being provided with a first resistance for supplying a first bias voltage to an inverting input terminal, and a second resistance which is disposed between the inverting input terminal and an output terminal of the inverting amplifier. The temperature detecting circuit is further provided with a non-inverting amplifier for amplifying an output from the inverting amplifier, a third resistance for supplying a predetermined reference potential to an inverting input terminal of the non-inverting amplifier, and a fourth resistance which is disposed between the inverting input terminal and an output terminal of the non-inverting amplifier.

Therefore, desirable temperature characteristics can be obtained by appropriately setting resistivities of the first and the second resistances, while a desirable output voltage value can be obtained by appropriately setting resistivities of the third and the fourth resistances.

Moreover, the temperature detecting circuit of the present invention has two bias voltage sources configured respectively with a series circuit including a constant current source and one or more stages of a diode or didoes, wherein the difference between the temperature characteristics is produced by a difference in element area of the diodes.

Therefore, the bias voltage sources can be easily set up in a single semiconductor integrated circuit.

Furthermore, a liquid crystal driving device of the present invention comprises the temperature detecting circuit and utilizing the output voltage from the non-inverting amplifier for driving a liquid crystal element, the liquid crystal driving device having a gain of the inverting amplifier, which is determined by the first and the second resistances and adapts to temperature characteristics of a liquid crystal panel, and having an output voltage level, which is determined by the third and the fourth resistances and the reference potential and adapts to a voltage required for driving the liquid crystal element.

Therefore, an arbitrary driving voltage can be obtained with any temperature characteristics suitable for the liquid crystal panel in use, by setting the first to fourth resistances and the reference potential, thus achieving a display constantly with the optimum contrast.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A temperature detecting circuit comprising:

an inverting amplifier for outputting a voltage in accordance with a difference between a first bias voltage from a first bias voltage source with relatively steep temperature characteristics and a second bias voltage from a second bias voltage source with relatively gradual temperature characteristics, the inverting amplifier outputting the voltage in accordance with a difference between the first bias voltage and the second bias voltage so as to perform temperature detection with relative accuracy between the first and the second bias voltage sources;

a first resistance for supplying the first bias voltage to an inverting input terminal of the inverting amplifier;

a second resistance which is disposed between the inverting input terminal and an output terminal of the inverting amplifier;

a non-inverting amplifier having a non-inverting input terminal for receiving the output from the inverting amplifier;

a third resistance for supplying a predetermined reference potential to an inverting input terminal of the non-inverting amplifier; and a fourth resistance which is disposed between the inverting input terminal and an output terminal of the non-inverting amplifier, so that the temperature detecting circuit performs temperature detection between at least the first and second bias voltage sources.

2. The temperature detecting circuit as set forth in claim 1, which includes the first and the second bias voltage sources, wherein said first and said second bias voltage sources respectively have series circuits connecting a constant current source and one or more stages of a diode or diodes, between power supplying lines, and supply the bias voltages to input terminals of the inverting amplifier from their respective junctions between the constant current sources and the one or more stages of the diode or diodes, so as to create the difference between the temperature characteristics by a difference in element area between the diodes of the respective bias voltage sources.

3. The temperature detecting circuit as set forth in claim 2, wherein the numbers of the diodes which are serially connected to the constant current source are different between said first bias voltage source and said second bias voltage source.

4. The temperature detecting circuit as set forth in claim 2, wherein an area per diode of the diodes which are serially connected to the constant current source is different between said first bias voltage source and said second bias voltage source.

5. The temperature detecting circuit as set forth in claim 2, wherein the diodes which are serially connected to the constant current source in at least one of said first and said second bias voltage sources are respectively connected in parallel with still other diodes, and the numbers of diodes respectively connected in parallel with the diodes which are serially connected to the current source are different between the first bias voltage source and the second bias voltage source.

6. The temperature detecting circuit as set forth in claim 2, wherein the diodes respectively provided in said first and said second bias voltage sources are arranged in a single semiconductor integrated circuit.

7. A liquid crystal driving device, comprising the temperature detecting circuit of claim 1 and utilizing the output voltage from the non-inverting amplifier for driving a liquid crystal element, said liquid crystal driving device having a gain of the inverting amplifier, which is determined by said first and said second resistances, adapts to temperature characteristics of a liquid crystal panel, and having an output voltage level, which is determined by said third and said fourth resistances and the reference potential, adapts to a voltage required for driving said liquid crystal element.

8. A temperature detecting circuit, comprising:

first and second input terminals for receiving first and second bias voltages that vary differently in accordance with a change in temperature;

a third input terminal for receiving a predetermined reference potential;

an inverting amplifier including an inverting input terminal connected with said first input terminal, a non-inverting input terminal connected with said second input terminal, and an output terminal for outputting a voltage corresponding to a difference between (a) a voltage of said inverting input terminal and (b) a voltage of said non-inverting input terminal;

a non-inverting amplifier including a non-inverting input terminal connected with said output terminal of said inverting amplifier, an inverting input terminal connected with said third input terminal, and an output terminal for outputting a voltage corresponding to a difference between (a) a voltage of said non-inverting input terminal and (b) a voltage of said inverting input terminal;

a first resistance which is disposed between said first input terminal and said inverting input terminal of said inverting amplifier;

a second resistance for connecting between said output terminal of said inverting amplifier and said inverting input terminal of said inverting amplifier;

a third resistance which is disposed between said third input terminal and said inverting input terminal of said non-inverting amplifier; and a fourth resistance for connecting between said output terminal of said non-inverting amplifier and said inverting input terminal of said non-inverting amplifier, so that the temperature detecting circuit performs temperature detection between at least the first and second bias voltages.

9. A temperature detecting circuit, comprising:

first and second input terminals for receiving first and second bias voltages that vary differently in accordance with a change in temperature;

a third input terminal for receiving a predetermined reference potential;

an inverting amplifier including an inverting input terminal, a non-inverting input terminal, and an output terminal, said non-inverting input terminal being connected with said second input terminal;

a non-inverting amplifier including an inverting input terminal, a non-inverting input terminal, and an output terminal, said non-inverting input terminal being connected with said output terminal of said inverting amplifier;

a first resistance group including a plurality of resistances in a series connection that connect between said output terminal of said inverting amplifier and said first input terminal;

a first switch for selectively connecting or disconnecting between said inverting input terminal of said inverting amplifier and each resistance in said first resistance group;

a second resistance group including a plurality of resistances in a series connection that connect between said output terminal of said non-inverting amplifier and said third input terminal; and a second switch for selectively connecting or disconnecting between said inverting input terminal of said non-inverting amplifier and each resistance in said second resistance group.

10. The temperature detecting circuit as set forth in claim 8, comprising:

first and second bias voltage sources for respectively generating the first and the second bias voltages, wherein:

said first and said second bias voltage sources are respectively composed of a constant current source and one or more stages of a diode or diodes connected in series with said constant current source, and a junction between said constant current source and said one or more stages of a diode or diodes, respective junctions of said first and said second bias voltage sources are connected with said first and said second input terminal, respectively, and the first and the second bias voltages vary differently in accordance with a change in temperature by a difference in element area of the respective diodes of said first and said second bias voltage sources.

11. A temperature detecting circuit, which includes an inverting amplifier for outputting a voltage in accordance with a difference between a first bias voltage from a first bias voltage source and a second bias voltage from a second bias voltage source, the inverting amplifier outputting the voltage in accordance with a difference between the first bias voltage and the second bias voltage so as to perform temperature detection with relative accuracy between the first and the second bias voltage sources, said temperature detecting circuit comprising:

a first resistance for communicating the first bias voltage to an inverting input terminal of the inverting amplifier;

a second resistance which is disposed between at least the inverting input terminal and an output terminal of the inverting amplifier;

a non-inverting amplifier having a non-inverting input terminal for receiving at least the output from the inverting amplifier;

a third resistance for communicating a predetermined reference potential to an inverting input terminal of the non-inverting amplifier; and a fourth resistance which is disposed between at least the inverting input terminal and an output terminal of the non-inverting amplifier, so that the temperature detecting circuit performs temperature detection between at least the first and second bias voltage sources.

* * * * *